United States Patent [19]

Durraffourt

[11] 4,125,177

[45] Nov. 14, 1978

[54] RAILWAY BRAKING APPARATUS

[75] Inventor: Jean F. Durraffourt, Plessis Trevise, France

[73] Assignee: WABCO Westinghouse, Freinville-Sevran, France

[21] Appl. No.: 779,700

[22] Filed: Mar. 21, 1977

[51] Int. Cl.[2] ..... B61K 7/02

[52] U.S. Cl. ..... 188/62; 104/26 A; 246/182 A

[58] Field of Search ..... 188/62; 104/26 R, 26 A; 246/182 A

[56] References Cited

U.S. PATENT DOCUMENTS

| | | | |
|---|---|---|---|
| 1,442,282 | 1/1923 | Lyttle | 188/62 X |
| 1,831,802 | 11/1931 | Bone | 104/26 A |
| 2,858,907 | 11/1958 | Brown | 104/26 A X |
| 3,107,751 | 10/1963 | Garrett, Jr. et al. | 188/62 |
| 3,621,942 | 11/1971 | Danieli | 188/62 |

*Primary Examiner*—George E. A. Halvosa

*Attorney, Agent, or Firm*—J. B. Sotak; R. W. McIntire, Jr.

[57] ABSTRACT

Railway braking apparatus for frictionally engaging and retarding the wheels of railroad cars which includes a series of pneumatic cylindrical operators located between two adjacent crossties along the trackway. The piston of each pneumatic cylindrical operator is coupled to a frictional braking bar through a mechanical advantage pivotal lever. Each lever is pivotally connected to a rigid welded frame assembly including apertured lugs and pivot pins. The rigid force absorbing frame assembly is carried by the two adjacent crossties and includes a crosspiece member to which the cylinder of each pneumatic cylindrical operator is pivotally connected. The pivotal lever is constructed of a plurality of plates, two bolt accommodating tubes and a series of filler plates or slotted shims which allow for the lateral adjustment of the frictional braking bars and permits quick and easy assembly and dismantling of the actuators, levers and braking bar.

16 Claims, 5 Drawing Figures

RAILWAY BRAKING APPARATUS

FIELD OF THE INVENTION

The present invention relates to railway braking apparatus which is especially adapted for use in retarding railroad vehicles.

The invention more particularly pertains to a pneumatic railway brake or car retarder comprising two frictional braking bars juxtaposed to form pincers which are arranged to be parallel to a track or running rail and are disposed on both sides of the rail. The brake or retarder is provided with two lines of compressed fluid cylinders situated on both sides of the running rail with each line of cylinders being adapted to control the movement and the action of a series of mechanical transmission members which are connected to the respective one of an associated frictional braking bar.

BACKGROUND OF THE INVENTION

The rail brakes or car retarders are essentially used in railroad sorting or classifying to slow down or brake the carriages or vehicles of incoming trains which are isolated and cut into individual or sections of several carriages or cars which are directed toward and are moved over and down the hump of a classification or marshalling yard.

In some well-known track braking apparatus of this type, the air operating cylinders are mounted so that their axes are horizontal with respect to ground level. As a result, the dimensions of these previously known track brakes are generally very large, since the horizontal stroke of the pistons within the cylinders has to be taken into account in order to determine the space transversely occupied by the equipment.

On the other hand, it is also known to provide and equip tracks of sorting or class yards and the like with railway braking apparatus whose cylinders are arranged in one or a single line alongside the track rail. In this case, the gripping or pinching action on the sides of the wheel is brought about by having the single line of cylinders simultaneously operate both of the frictional bars which are located on opposite sides of the running rail. In this latter type of track brake, the operation of the braking bar which is located on the other side of the rail from pistons and cylinders, makes it necessary to arrange for disposition of the movable levers underneath the rail which is both expensive and cumbersome.

The subject invention eliminates the above-mentioned disadvantages and one object being in particular to provide track braking apparatus for railway vehicles which is not very expensive, takes up less space in the transverse direction and is very easy to assemble and disassemble while having a great rigidity and modular form.

For this purpose, the track braking apparatus is especially adapted for railroad vehicles and involves a car retarder which comprises at least one frictional braking beam situated parallel to a track running rail and supported on sleepers or crossties. The braking or retarding apparatus includes at least one elastic actuator or power operator, such as, a compressed-fluid and/or spring assisted cylinder one end of which, namely, either chamber body or piston rod, is capable of pushing through the intermediary of a mechanical transmission member (directly in the case of tightening by the actuator or indirectly in the case of tightening by the wheel pressure) the frictional braking beam against at least one wheel of a vehicle moving over the track rail. The apparatus is characterized in that the mechanical transmission member is a brake lever located in a median plane above the upper part of the sleepers at a small distance therefrom. The fulcrum point line of rest of the lever is linked to a support which is disposed on at least two adjacent sleepers or crossties and which is at least transversely attached thereto. In between the crossties, there is lodged or located the compressed fluid cylindrical operator or actuator whose other end, namely, the end opposite to that which is linked to the brake lever, is pivotally jointed to a reaction support or holder which is also fixed to at least the two adjacent sleepers or ties in such a manner so as to lodge or locate the cylindrical operator below the upper part of the lever and between the sleepers or ties. Thus, the crossties absorb the longitudinal and transverse reactions that the wheels transmit to the frictional braking beams. The axis of the brake cylinder and, in turn, the axis of expansion of the flexible operator or actuator is substantially perpendicular to the line or, respectively, to the plane which meets the fulcrum point or line of rest of the brake lever at the point, line or spot of connection of the cylinder or actuator with the brake lever. This tends to reduce to a minimum the strain and stress applied to the friction beam and, in turn, the force that is transmitted by the brake cylinder to its reaction support and to the lever.

The reaction support for the cylinder or operator is disposed at the lower part between the two adjacent sleepers or crossties.

SUMMARY OF THE INVENTION

According to a particularly compact embodiment of this invention, the reaction stand of the railway braking apparatus is formed by a closing mechanism support for the brake cylinder. The support rests upon two adjacent crossties and is fixed attached to the upper part of the crossties. The body of the brake cylinder is located between the two adjacent crossties beneath the lower part of a brake lever. The brake lever is mechanically pivotally connected to the piston of the brake cylinder. That is, the brake cylinder has a piston rod provided with an eyelet which contains a pivot pin whose opposite ends are attached and linked to the brake lever so as to mechanical connect to the piston of the cylinder. The weight of the brake lever as well as that of the piston of the cylinder and masses associated therewith, namely, the rod, the pivot in, etc. are utilized as principal means, namely, gravity, for returning the brake to its released or ineffective position.

In practice, there is provided at least two unilaterally acting railway brake assemblies which are substantially identical and are symmetrically disposed with respect to the running rail. A brake assembly is situated on both sides of the same wheel or wheels of the railroad cars and each assembly operates simultaneously with the object of gripping and clamping the wheel in accordance with the thickness of rim in such a way so as to bring about minimum lateral pressure on said wheel and results in the balancing of the opposed forces of the two frictional braking bars which face one another.

In accordance with another method of assembling, there are at least two unilaterally acting railway brakes which are disposed on the outside of each of the two rails of a railroad trackway over which the moving or rolling vehicles or cars to be braked. In such an arrangement, each one of the braking bars squeezes a different wheel on the same axle without there being any braking bar assemblies situated in the space between the two track rails. Conversely, there may be provided at least two unilaterally acting railway brake assemblies which are suitably disposed on the inside of or between the two rails of railroad trackway over which the vehicles to be braked are rolling so that each braking bar exerts a retarding force on a different wheel on the same axle without there being a railway brake assembly taking up space on the outside of the track rails.

Further, it is understood that the piston of each cylinder may be arranged to be brought to bear against a stop, its rest or depressed position in such a manner that in case one of the cylinders fails to operate, the force transmitted by the other cylinder to the frictional braking bar can be balanced, after a slight lateral displacement of the railroad car wheel, by the stop of the conjugate cylinder.

According to a particularly lightweight embodiment of the invention, the brake lever is a frame which is specially in the form of a welded construction and which supports and controls the frictional braking bar with respect to the wheel to be braked. The supporting frame comprises at least two transverse extension arms having a bearing ledge or overhang portion for carrying the frictional braking bar. The frame includes cross-braces made up of several longitudinal plates which are parallel to the frictional braking bar and are rigidly fixed by being welded to the extension arms. The longitudinal plates serve to support the means for transversely controlling the frictional braking bar for moving it toward or away from the wheel to be braked. The transverse control means includes a pair of tubes which are rigidly attached to the longitudinal plates. The tube form passages for accommodating through bolts which are used for fastening the frictional braking bar at the inner end of the tubes. It is possible to initially adjust the braking bars and to compensate for subsequent frictional wear through the intermediary of adjusting plates or slotted shims which are placed at each end of each of the tubes. These adjusting plates having a general flat annular shape are provided with a side slot which makes it possible to insert or remove them so as to adjust the position of the frictional braking bar simply by loosening the nut on the bolt and without the need of extracting the bolts from the tubes.

In other words, the frictional braking bar and the respective nuts and threaded bolts are fixedly attached to each of the tubes with the aid of a set of filler plates or spacer washers the number of which remains constant. The relative position of the frictional braking bar with respect to the running rail may be adjusted by loosening the nuts on the through bolts and then transferring one or more of the filler plates or spacers from the space lying between the frictional braking bar and inner end of each of the tubes to the spot lying between the threaded nut of each of the bolts and the other or outer end of each of the tubes, or vice versa, so as to afford adjustment without the need for extra filler plates, while using a bolt thread of minimum length.

According to a very practical and economical embodiment of the invention, the frictional braking bar is a conventional track rail section substantially identical with that of the standard track rail with one of the side or inner part faces of the head of the rail serving as the frictional wheel engaging surface. This frictional brake rail is supported in a substantially vertical manner by having the flange rest on the transverse extension arms. A pair of spaced apart holes are formed in the web portion between the head and the flange of the brake rail. The threaded end of each bolt extends through the holes until the bolthead abuts and ends in an enlarged grommet member which takes the form of an annular bearing insert having a reduced diameter portion which is slightly smaller and is fitted into the borehole in the web of the rail. The grommet insert also includes an oversized annular or rim segmented flanged portion or rim which is situated on the bolthead side of the running rail and which has its rim bearing against the web of the frictional braking rail. In the concave space or cover between the head and flange of the rail web is situated a fish plate. The bolt head bears against the rim of the grommet and the shank of the bolts passes through holes drilled in the fish plate. Thus, the lateral face of the frictional brake rail on the side of the tubes rests against a fish plate which has a matching convex or semicurved shape. The outer face of the fish plate is planar against the flat filler plates or shims in such a manner that the braking bar may be adjusted. After loosening the nuts of the bolts which hold the frictional braking bar on the tubes, a small displacement or shifting of these fastening bolts in the direction toward the track running rail makes it possible to remove one or more of the shims so that the braking bar may be moved in the direction of the track running rail to compensate for wear. It will be appreciated that the bolthead and the nut end of the fastening bolts may be interchanged or reversed in order to mount the frictional braking onto the tubes.

The welded frame which forms the brake operating lever has the shape of a ⅃⌐, namely, a zee or double right-angled elbow, the lower horizontal arm or extension which supports the frictional braking bar serves as the lever fulcrum connection while the vertical section which is limited by longitudinal plates serves as a supporting means for the two tubes. The upper horizontal arm of the Zee frame is connected with a fluidic brake operating or actuating cylinder. The upper horizontal arm is effectively an extension of the tubes and forms the actual brake lever under which the brake operating cylinder or fluid actuator is located.

The brake lever is pivotally jointed to a solid frame which serves as support both for the lever fulcrum and a pivot connection for the other end of the cylinder or actuator. The rigid supporting frame includes two spaced apart bearing surfaces or plates which extend perpendicular to the running rail. A pair of stanchions or apertured lugs are welded to the top of the bearing plates which rest on two adjacent crossties or sleepers and form the guide or the pivotal points or axes of support for ghe brake lever. Under such an arrangement, the tangential reactive force exerted during braking of the wheel by the frictional braking bar are transmitted to the crossties. In practice, the frame is made up of two C or U-shaped channels which are turned upside down and are fitted over the two adjacent sleepers or crossties to which they are fastened by lagscrews. The two channels are interconnected between the sleepers by a cross-piece member, one of which serves as a reaction support of the pivot connection to the cylinder or actuator.

The frictional braking bar which is relatively rigid in the direction of the tightening of the brake may be interconnected to a plurality of adjacent brake levers. Each of the separate brake levers operated by an individual brake cylinder or fluid actuator which is supported on two adjacent crossties or sleepers in such a manner that the frictional braking bar transmits to one or several wheels facing one another the greatest part of the sum of the forces applied which are exerted upon said brake levers by the brake cylinders.

In another embodiment, the frictional braking bar which is relatively flexible in the direction of the tightening of the brake may be interconnected by several neighboring brake levers. Each of the brake levers is operated by a separate brake cylinder supported on two adjacent sleepers or crossties in such a manner that the friction braking transmits to one or several wheels facing one another only part of the sum of the forces applied which are exerted upon said brake levers by the brake cylinders.

It is especially evident from the characteristic features which have just been enumerated that the railway braking apparatus does not take up much space in the transverse direction, that it requires only a small excavation in the ballast between the crossties for accommodating the lower part of the brake cylinders and that it eliminates the need for any lever to extend underneath the running rail. Moreover, the distinct and separate location of the brake cylinders in relation to the force transmission members ensures for quick and easy disassembling of said brake cylinders for the purpose of repair and/or replacement.

DESCRIPTION OF THE DRAWINGS

Other objects and advantages of the present invention will become more readily apparent when reading the following description, not limitative of the invention, in conjunction with reference to the accompanying drawings, wherein.

DETAILED DESCRIPTION OF THE INVENTION

Figure 1:
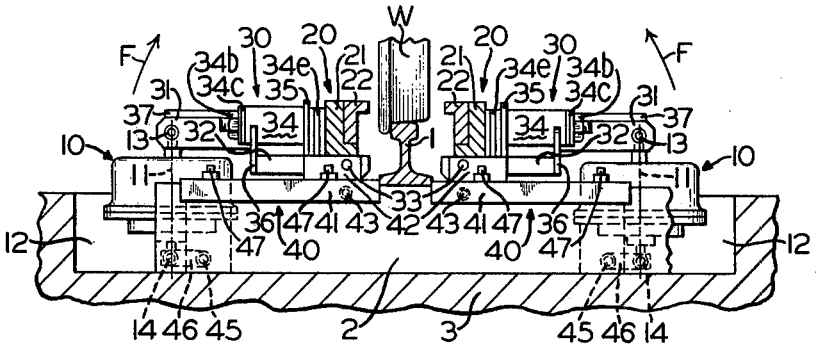
FIG. 1 shows a cross section of a track braking arrangement according to a first embodiment of the subject invention.

Referring now to the drawings, in particular to FIG. 1 there is illustrated the railway braking arrangement which is associated with a longitudinal section of a fixed running rail 1. The braking action takes place on opposite sides, and the track brake has a symmetrical configuration with respect to the running rail 1. The track is mounted in a conventional manner on sleepers or crossties 2 which rest upon the ground or a ballast roadbed 3. Preferably, the sleepers or ties 2 are constructed of very thick wooden beams, but it is understood that they may be made of any other suitable material such as, concrete, steel or the like for carrying the rails of a railroad track.

In this exemplified embodiment, the track brake or car retarder disposed on both sides of the track rail is made up of various elements or components which form a series of operating units. The operating units are disposed along each side of the rail 1 in a straight line and each unit includes a compressed air cylinder or pneumatic actuator 10, a force-transmitting and amplifying member or mechanical advantage means 30 and a rigid frame or support 40 which carry a movable frictional brake beam or braking means 20. As shown in FIG. 1, the pneumatic brake cylinders 10 are arranged in series with their center lines or axes 11 being perceptibly vertically disposed. Since the cylinders 10 are situated remotely from and are located completely on the outside of the beams 20 and members 30, they can be easily disassembled. Moreover, they are located in excavations 12 which are not very deep cuts in the ground 3 or the ballast surrounding ties 2.

Figure 2:
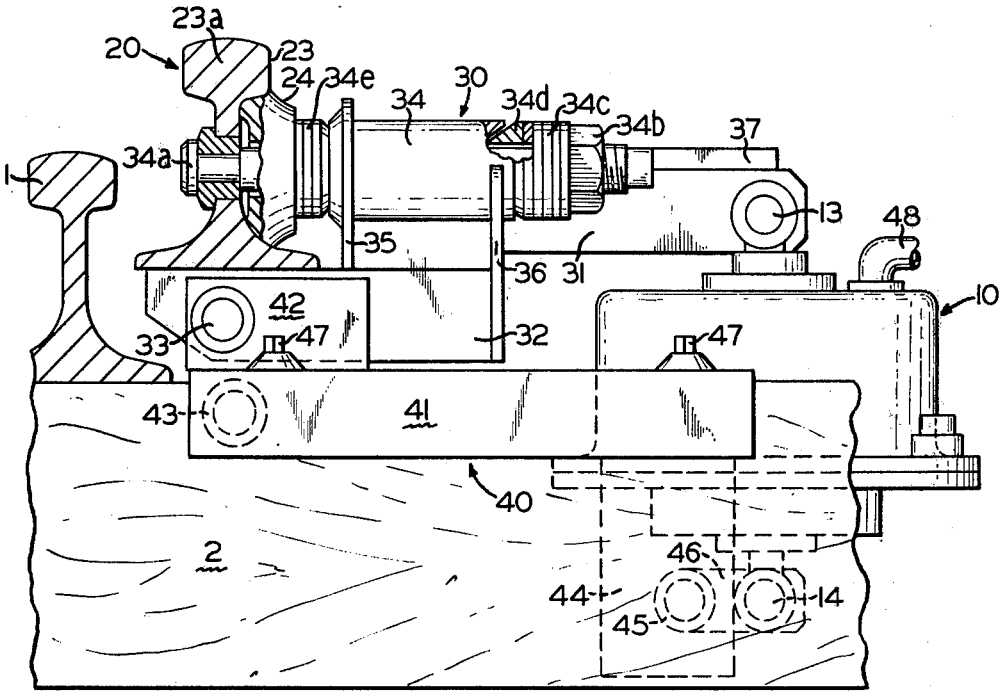
FIG. 2 shows a cross section, substantially enlarged, of part of the track brake according to a second embodiment of the subject invention.
Figure 3:
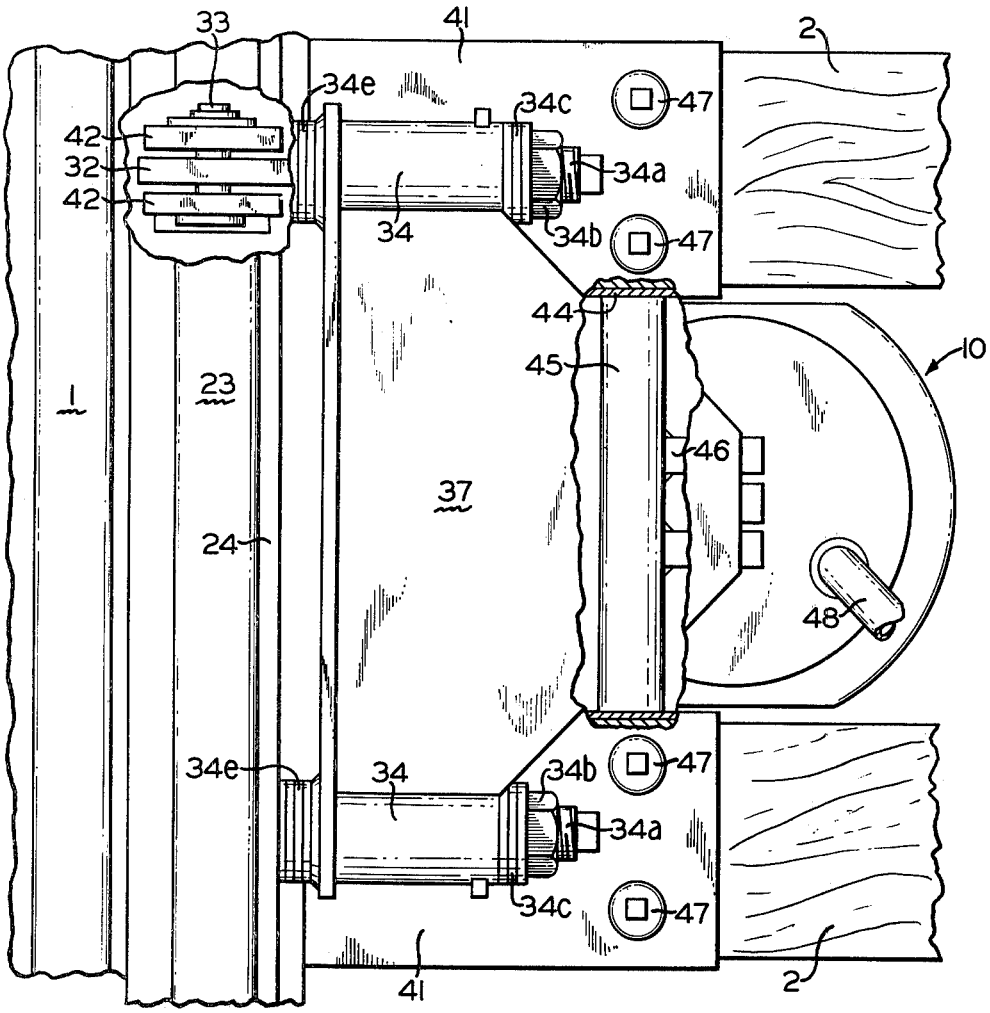
FIG. 3 is a plan view with cut-out portions of the track brake shown in FIG. 2.

In viewing FIGS. 1 and 2, it will be noted that a pivoting pin and eyelet form pivotal joint or hinge 13 which serves to attach the rod of the piston of the cylinder 10 to the force transmitting member 30, and a fastening pin and eyelet form hing or pivotal joint 14 which serves to hold the body of the cylinder 10 relative to the rigid frame or frame work 40.

Each of the frictional brake beams or braking bars 20, schematically represented in FIG. 1, consists of a supporting section 21 and an L-shaped wearing section or brake shoe 22. In the case of the second arrangement or embodiment in FIG. 2, the frictional wearing section or shoe 22 is replaced by a conventional I-shaped track rail which is mounted vertically wherein the rail head is directed upwards and the web section is vertically situated and against which lies a fish plate 24. The braking bar or rail 23 is arranged to exert a friction action on the sides of the wheel via the inward or inner side of its head 23*a* which may be provided with a machined surface. It will be appreciated that the rail 23 could also be disposed horizontally with the web being horizontal, but the vertical arrangement has the advantage of facilitating the placing on a rail in a curve by bending said friction rail 23 manually in situ. However, it will be understood that the mounting arrangement with the web being in a horizontal position provides the frictional braking beam with increased strength and greater rigidity.

In addition, the member 30 and the rigid frame 40 are preferably welded parts weldment which will be described in more detail with reference to FIGS. 2 to 5.

In fact, these figures show in greater detail the welded frame-like member 30 forming the brake lever and the welded frame 40 which serves as a support for the hinged joints of the floating brake lever and the pneumatic cylinder.

Figure 4:
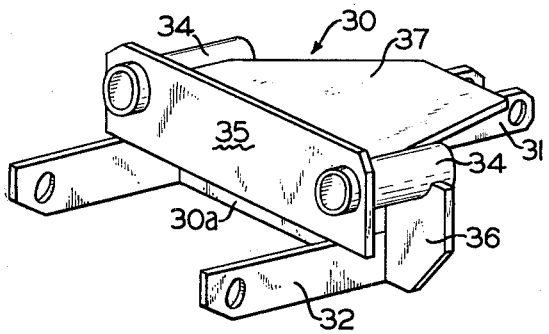
FIG. 4 shows a perspective view of a frame appertaining to the brake lever which is part of the track brakes shown in the FIGS. 1 and 2.
Figure 6:
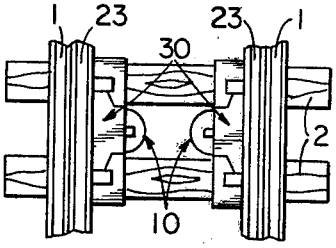
FIG. 6 shows a top plan view of the present invention in which two unilaterally acting braking bars are disposed on the inside of both of the track rails.
Figure 7:
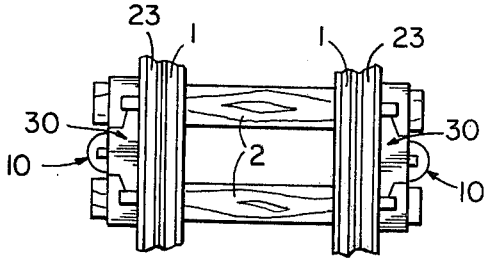
FIG. 7 shows a top plan view of the present invention in which two unilaterally acting braking bars are disposed on the outside of both of the track rails.

A comparative view of the member 30, a linear perspective of which is also shown in FIG. 4, will show that the general shape is a ⊔⊓, namely, a Zee or double right-angled knee or elbow. It will be seen that the member 30 is composed of longitudinal and transverse parts welded together or else may come from a foundry in a single or one piece. In the midst of the transverse parts, there are two apertured elongated plate bar members 31 which are welded in spaced relationship to the underside of a plate 37 and which receive a fastening pin between them to produce the pivotal joint 13 with the eyelet which is formed on the end of the rod of the piston of the cylinder 10. It will also be seen that two extension arms or bracket bars 32 each include apertures or holes formed near their extremities for providing a pivot connection about the same longitudinal pin 33 which cooperated with a pair of upstanding apertured lugs or ears 42 welded to the rigid frame 40 adjacent running rail 1. As shown, two hollow cylinders or tubes 34 are welded into a cross plate member 36 which is situated above the extension arms 32.

Thus, the base of the frictional braking rail 23 rests upon the upper horizontal edges of the extension arms or bars 32 and may be rigidly fixed or securely held to the frame forming the brake lever 30 by means of a pair of bolts 34*a* which pass through the respective metal tubes 34. The innermost ends of bolts 34*a* include a collared grommet which fits into a suitable hole in the web of rail 1 so that the bolts effectively pass through the running rail 23 and also pass through holes in the fish plate 24. The outer ends of bolts 34*a* are threaded to accommodate a tightening nut 34*b* and also have adjusting filler plates or slotted shims 34*c* interposed between nuts 34*b* and tubes 34. A centering cone 34*d* may be provided between the filler plates 34*c* and an internally tapered or chamfered edge of the tubes 34, as shown in FIG. 2. Further, it will be noted that the apertured shims 34*e* may be inserted between fish plate 24 and the inner end of tubes 34 which extend slightly beyond plate 35 to provide an adjustment to compensate for frictional wear on the wheel engaging surfaces of the brake beams 20. A vertical part or member 30*a* of the brake lever 30 is welded to the underside of the tubes 34 as shown in FIG. 4.

The longitudinal plate metal ports or elements of the floating or force conveying member 30 are formed by two vertical interlocking and stiffening plates 35, 36. The horizontal support plate 37 is welded to each of the tubes 34 and functions as a crossbrace member for the transverse supporting bars 31 of the brake lever 30.

Thus, the movable lever assemblage 30 is made up of a plurality of welded parts and forms a rigid, compact and durable structure in one-piece framework which makes it possible and capable of absorbing the various stresses and of compression, flexion, torsion, tension and the like which occur and are present during braking operation of the railway vehicles. The integral lever is a simple device which may be quickly and easily manually adjusted to offset for the wear on the surface of brakes in service and to permit the repositioning of the new shoes 22 or heads 23*a* in relation to the running rail 1.

Figure 5:
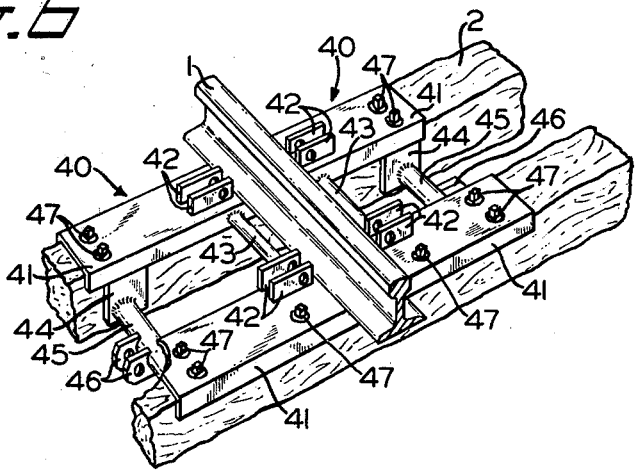
FIG. 5 shows a perspective view of the rigid frames or supports mounted on the sleepers and forming part of the track brakes shown in the FIGS. 1 and 2.

Referring now to the welded frame 40, a perspective view of which is also shown in FIG. 5, there is illustrated two U-beams or channel members 41, one on each side of the running rail 1 overlapping the sleepers or ties 2. It will be noted that to each of these beams 41 are welded two upper or upstanding apertured tabs or ears 42 for accommodating the joint pin 33 of the pivotal brake lever 30. A crosspiece or crossbrace member 43 is welded to the depending inner sides of the channel members 41 near the track rail 1. The crossbrace 43 takes the form of a tube or hollow bar which is interposed between the two metal channels on adjacent ties 2. A pair of depending ears or tab members 44 are located at the outer extremity of the same frame 40. The tab plates are arranged so as to face one another and are interconnected by a welded crosspiece which takes the form of a hollow bar or tube 45 which has a pair of spaced outwardly extending apertured lugs 46 attached thereto. The lugs 46 provide a support and fixed point for accommodating a fastening pin and the cylinder eyelet to form the pivot connection for the body of the cylinder 10. It will be noted that the design of the welded frame 40 is relatively simple and that mounting it on the sleepers or crossties 2 merely requires insertion and tightening of the lag screws 47 through the appropriate holes in the top of channel member 41.

It will be appreciated that the two pair of upper ears 42 form bearing points which are perpendicular to the track rail 1 for guiding the pivotal movement of the brake lever 30 about the pivot pins 33 so as to transmit to the welded frame 40 and thence to the two adjacent sleepers 2, the tangential reactive force which is created during braking action of the wheels by the frictional braking bars 20.

The above-mentioned railway braking arrangement and in particular the described structure operates in the following manner: First, let us assume apparatus is in the rest position, in the position as shown in FIG. 1. Under this condition, the actuating cylinders 10 are without any compressed air or are not being supplied with any other fluid under pressure. The railway brake or car retarder is prepared for operation by placing pneumatic cylinders 10 under fluid pressure by connecting conduits 48 to a suitable supply source. The supply of pneumatic pressure causes the expansion of the pistons within the cylinders. The movement of the pistons causes the pivot connections 13 to rise or move vertically relative to the fixed pivotal connections 14. The vertical movement of pivot points 13 results in a counterclockwise motion or pivoting of the brake lever 30 about the pivotal pin 33 in accordance with the arrows F as viewed in FIG. 1. Now, when the wheel W of a railroad car enters the railway brake or car retarder, it spreads and moves the two frictional braking bars 20 apart and away from the center of the rail 1 depending upon the thickness or width of the entering wheel W. Thus, the incoming wheel is subjected to a tangential braking force produced by the fluid pressure acting upon the pistons of the cylinder 10 and transmitted by means of the two tubes 34 and the adjacent extension arms 32 which together with the bars 31 form the force amplifying or mechanical advantage lever. The forces, which are developed in the triangle formed by the lever members 30, the cylinders 10 and the rigid frames 40, are received by said frame 40 which transmits the reaction from the wheel to the respective pairs of two adjacent sleepers or ties 2 when a braking effort is being exerted upon the wheel W of the car.

It goes without saying that certain elements of the rail brake described herein can be modified while remaining within the scope of the invention. Thus, the fluid brake cylinders 10 may be either pneumatic or hydraulic. Further, it is also possible to interpose and utilize a spring in line parallel relationship with the cylinders for substracting or adding a force to the fluidic pressure. The welded member 30 may likewise consist of two horizontal bars or sections which starting from the piston rod point 13 spread apart to form a delta and are united with a plate, such as, 35, at their point of maximum width.

The railway braking apparatus herein has been described in relation with a fixed track rail 1, it is quite apparent that the braking apparatus can also be utilized with a floating or movable type of track rail. In the latter case, the pivot points 33 of the movable lever members 30 would be located in apertured ears or plates attached to the floating rail.

The end of stroke and rest position of the pistons of the cylinders 10 may be obtained either by means of a stop for the pistons within the cylinders 10 or alternately by means of obstructing devices for stopping the movable members 30 against the rigid frames 40 to permit a nonoperable actuator to effectively brake a wheel by allowing the conjugate actuator to shift the wheel transversely against the nonoperable braking bar.

The two opposite frames 40 located on both sides of the rail 1 may be formed one rigid block member which may completely support, for instance, in its center portion or section the rail 1 so that the reaction or reactive force of the wheels is prevented from being transmitted to the sleepers or ties 2 during the braking operation.

The frictional braking bars 20 may be one continuous member or may be made up of a number of sections, depending on its overall length. When the bars are continuous, its dimensions chosen so as to combine sufficient resistance with elasticity or flexibility thus making it possible for sides of the car wheels to be clamped with a relatively constant force while moving past several successive cylinders 10. Likewise, the fish plates 24 may be continuous or may be made up in sections depending on the overall length. In the latter case, the fish plates are each placed right against the frictional bar sections so as to overlap two adjacent bar sections. Further, the cross-sectional profile of the fishplates may be chosen so as to improve the transverse rigidity of the frictional braking rail.

Additionally, it is apparent that various other changes may be made in the above described retarder arrangement without departing from the spirit and scope of the invention, and therefore, it is intended that all of the subject matter contained in the foregoing or shown in the accompanying drawings should be interpreted as illustrative and not in a limiting sense.

Having now described the invention, what I claim as new and desire to secure by Letters Patent, is:

1. Railway braking apparatus for retarding railroad vehicles, of the type which comprises, at least one frictional braking bar disposed parallel to track rails and supported by the crossties, at least one power operated actuator, having a body, for moving the frictional braking bar into and out of engagement with the wheels of railroad vehicles traversing the track rails through the intermediary of a mechanical transmission means, characterized in that said mechanical transmission means includes a pivotal brake lever which is linked to one end of said power operated actuator and which is located in a median plane above the upper part of the crossties at a small distance therefrom, said brake lever includes a welded frame which supports and controls the frictional braking bar with respect to the wheel to be braked, said welded frame includes at least two transverse extension arms for receiving on an overhang portion the frictional braking bar and being crossbraced by several longitudinal plates which are parallel to said frictional braking bar and are rigidly fixed to the extension arms, said longitudinal plates serve to support means for transversely controlling said frictional braking bar in order to move said frictional braking bar toward and away from the wheel to be braked, said transverse control means includes tubes which are rigidly attached to the longitudinal plates and which form passages for bolts for fastening said frictional braking bar on the end of the tubes with nuts and for allowing for the adjustment of said frictional braking bar through the intermediary of adjusting filler plates at each of the ends of said tubes, a pair of fulcrum points on said brake lever each of which is fixed to a bearing support frame which is disposed on at least two adjacent crossties and is transversely interconnected by a crosspiece member, said power operated actuator is located between said two adjacent crossties with another end linked to a reaction support which is fixed to the two adjacent crossties in such a manner so as to place the body of said power operated actuator below the upper part of the lever and between the crossties so as to sustain the longitudinal and transverse reaction force which is transmitted by the wheels of the railroad vehicles to the frictional braking bar.

2. Railway braking apparatus according to claim 1, characterized in that the expansion axis of said power operated actuator which includes a piston and a cylinder body is substantially perpendicular to a horizontal plane which intersects the fulcrum point of said brake lever when it is in its released position so as to minimize the required force transmitted by said power operated actuator through said reaction support and to said brake lever.

3. Railway braking apparatus according to claim 1, characterized in that said reaction support of said power operated actuator is disposed at a lower part between the two adjacent crossties.

4. Railway braking apparatus according to claim 2, characterized in that said reaction support of said power operated actuator is formed by a connecting link and a crossbar which is attached to said bearing support so that the body of the cylinder is located between the two crossties beneath said bearing and said brake lever is mechanically connected to the piston of said power operated actuator.

5. Railway braking apparatus according to claim 4, characterized in that said power operated actuator includes a piston rod having an eyelet for a pivot pin so that extremity opposite the piston is linked to the brake lever.

6. Railway braking apparatus according to claim 4, characterized in that the mass of the brake lever as well as mass of the piston of said power operated actuator and the masses associated therewith are utilized as principal means for returning the brake to its release position.

7. Railway braking apparatus according to claim 1, characterized in that at least two unilaterally acting braking bars which are substantially identical and are symmetrical with respect to the track rail are disposed on both sides of the same railroad wheel and are operated simultaneously by separate power operated acuators, including a piston and cylinder, in order to clamp the wheel over the length of its rim and to minimize lateral shifting of said wheel and the balancing of the opposed forces of the two frictional braking bars which are located opposite one another.

8. Railway braking apparatus according to claim 7, characterized in that in the release position the piston of each cylinder rests upon a stop in such a manner that in case one of the actuators fails to operate, the force transmitted by the other actuator to the frictional braking bar can be balanced after a slight lateral displacement of the vehicle wheel, by the stop of the conjugate cylinder.

9. Railway braking apparatus according to claim 1, characterized in that at least two unilaterally acting braking bars are disposed on the outside of both of the track rails so that each braking bar retards a different wheel on the same axle without there being a braking bar taking up space between the two rails.

10. Railway braking apparatus according to claim 1, characterized in that at least two unilaterally acting braking bars are disposed on the inside of the track rails so that each braking bar retards a different wheel on the same axle without there being a braking bar taking up space on the outside of the rail.

11. Railway braking apparatus according to claim 1, characterized in that said adjusting filler plates have a general flat annular shape and are provided with a side slot which makes it possible to insert or remove said filler plates so as to adjust the position of the frictional braking bar after simply loosening the nuts on the bolts but without necessitating the pulling of said bolts out of the tubes.

12. Railway braking apparatus according to claim 11, characterized in that said frictional braking bar and said nuts of the bolts are fitted on each tube with the aid of a set of filler plates the number of which remains constant and the position of said frictional braking bar in relation to the rail being adjusted by transferring after loosening said nuts of the bolts one or more of said filler plates from a space lying between said frictional braking bar and one end of said tubes to a space lying between the nuts of the bolts and the other end of said tubes and vice versa so as to afford adjustment without the need for extra filler plates and thereby using bolts having minimum thread length.

13. Railway braking apparatus according to claim 1, characterized in that said frictional braking bar is a rail section substantially identical to the track rails and arranged to have one of the side faces of the head serving as the friction engaging surface, said frictional braking bar being supported in a substantially vertical manner by said transverse extension arms and having through holes formed in its web for accommodating said bolts, the bolthead of each bolt ends in a bearing insert having a reduced diameter portion inserted into said through holes, said bearing insert having a flanged segment which is situated on the inner side of the braking bar and resting against the web of said frictional braking bar, a fish plate is seated against the concave shape of the outer side of said frictional braking bar and includes through holes for receiving said fastening bolts, flat filler plates are situated between said fish plate and said tubes so that after loosening of the bolts for mounting said frictional braking bar on the tubes a small displacement of these fastening bolts in the direction of the track rail makes it possible to remove the flanged segment which forms the stop of the bolt head and to thus free said frictional braking bar from the fastening bolts.

14. Railway braking apparatus according to claim 1, characterized in that said welded supporting frame forming the brake lever has the shape of a double right-angled elbow with one horizontal arm supporting said frictional braking bar and serving as the fulcrum point for said brake lever vertical section which serves as a support for said tubes, and another horizontal arm is pivotally connected to the power operated actuator and being roughly the extension of the tubes, forms the actual brake lever under which the power operated actuator is located.

15. Railway braking apparatus according to claim 1, characterized in that said bearing support frame has bearing lugs perpendicular to the track rail which form the guide for the fulcrum point of support for said brake lever so as to transmit to the crossties the tangential reactive force exerted during braking by the wheel on said frictional braking bar.

16. Railway braking apparatus according to claim 1, characterized in that said bearing support frame consists of two channel members turned upside down and seated over the two adjacent crossties to which they are fixed, said channel members are interconnected between said two crossties by at least one crosspiece which serves as a reaction support to said power operated actuator.

* * * * *